US007216887B2

(12) United States Patent
Riepler

(10) Patent No.: US 7,216,887 B2
(45) Date of Patent: May 15, 2007

(54) BOARD-TYPE RUNNER DEVICE WITH AT LEAST ONE DEVICE FOR INCREASING RESISTANCE TO SLIPPING AND FRICTION

(75) Inventor: Bernhard Riepler, Wagrain (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 196 days.

(21) Appl. No.: 10/828,922

(22) Filed: Apr. 21, 2004

(65) Prior Publication Data

US 2004/0213960 A1 Oct. 28, 2004

(30) Foreign Application Priority Data

Apr. 23, 2003 (AT) ..... A 612/2003

(51) Int. Cl.
*A63C 5/06* (2006.01)

(52) U.S. Cl. ..... 280/608; 441/68

(58) Field of Classification Search ..... 280/604, 280/608, 609, 610, 11.14, 14.22; 441/68, 441/74, 136
See application file for complete search history.

(56) References Cited

U.S. PATENT DOCUMENTS 3,332,697 A * 7/1967 Hagen ..... 280/14.21
3,378,274 A * 4/1968 Poppen ..... 280/18
3,437,345 A * 4/1969 Berta ..... 280/607
4,129,911 A * 12/1978 McDonald et al. ..... 441/74
4,148,500 A * 4/1979 Nidecker ..... 280/604
4,233,098 A * 11/1980 Urbain ..... 156/242
4,533,150 A * 8/1985 Hardy ..... 280/14.28
4,595,215 A * 6/1986 Tiitola ..... 280/604
4,619,619 A * 10/1986 Muse, Jr. ..... 441/65
4,635,954 A * 1/1987 Arnsteiner ..... 280/604
4,767,369 A * 8/1988 Snyder ..... 441/68
4,844,500 A * 7/1989 Fischer ..... 280/604
4,883,436 A * 11/1989 Oakland ..... 441/65
4,894,034 A * 1/1990 Brown, III ..... 441/65
5,137,483 A * 8/1992 Nealy ..... 441/75
5,221,104 A * 6/1993 Bejean et al. ..... 280/604
5,344,177 A * 9/1994 Rouser et al. ..... 280/610
5,454,743 A * 10/1995 Simonson ..... 441/74
5,501,825 A * 3/1996 Jodelet ..... 264/46.5
5,727,807 A * 3/1998 Krafft et al. ..... 280/609
5,797,779 A * 8/1998 Stewart ..... 441/74
5,865,459 A * 2/1999 Piegay ..... 280/602
5,954,357 A * 9/1999 Golling ..... 280/612
6,105,990 A * 8/2000 Sutherland ..... 280/604
6,659,492 B2 * 12/2003 Gousie ..... 280/604

FOREIGN PATENT DOCUMENTS

DE 297 09-232 4/1998
DE 201 20 351 4/2002

* cited by examiner

*Primary Examiner*—Christopher Bottorff
(74) *Attorney, Agent, or Firm*—Collard & Roe, P.C.

(57) ABSTRACT

The invention relates to a board-type runner device (1), consisting of at least a top layer (2) with a top surface (4) and a running layer (3) with a running surface (5) lying opposite it and optionally having edging elements (6) extending in the longitudinal direction of the runner device (1), and the top surface (4) of the top layer (2) and/or the running surface (5) of the running layer (3) has at least one recess (13, 14). The at least one recess (13; 14) is provided with a device (21) for increasing slipping and friction resistance at the running surface (5) and/or top surface (4) if necessary, at least in the region of the recess (13; 14).

26 Claims, 11 Drawing Sheets

BOARD-TYPE RUNNER DEVICE WITH AT LEAST ONE DEVICE FOR INCREASING RESISTANCE TO SLIPPING AND FRICTION

BACKGROUND OF THE INVENTION

1. Field of the Invention

The invention relates to a board-type runner device, consisting of at least one top surface and a slipping layer with a slipping surface opposing it, and optionally edging elements extending in the longitudinal direction of the runner device, the top surface of the top layer and/or the running surface of the running layer having at least one recess.

2. The Prior Art

The idea of providing recesses in part regions of surface layers of runner devices and placing insert elements in these recesses is already known from the prior art. A runner device of this type is known from document DE 201 20 351 U1, for example. The described runner device has a running layer on the bottom surface directed towards the ground, which may be fitted with longitudinally extending edges if necessary, the surface and optionally side faces of which are coated with a surface coating. At least one orifice is provided in this surface layer, which is filled with at least one insert, and the contour of the respective insert, which may be a single piece or a plurality of pieces, conforms to the contour of the orifice.

The purpose of such features known from the prior art has been to use the relevant parts of the surface layer to give skis a more attractive aesthetic appearance and improve the technical properties of the ski, such as resistance to wear, increased strength and rigidity, as well as improved damping properties.

A ski or snowboard is also known from document DE 297 09 232 U1, in which the zones susceptible to scratching have a surface made from materials with a relatively high impact and abrasion resistance.

The purpose of this design of ski or snowboard is to ensure that the ski surface does not exhibit wear, after longer periods of use, and provide an inexpensive means of manufacturing the ski or snowboard.

SUMMARY OF THE INVENTION

The objective of the invention is to improve handling of a runner device by a user. Yet another objective of the invention is to enhance the comfort of the runner device during use.

This objective is achieved by the invention due to the fact that the at least one recess co-operates with a device intended to increase slipping or friction resistance at the running surface and/or at the top surface, at least in the region of the recess, advantageously providing a climbing and/or handling aid integrated in the runner device which can be activated as and when required and facilitates carrying. If the device is provided in the running surface, the slipping and friction resistance in at least certain regions can be increased without the need for additional external components when the device is in the active position, thereby obviating the need for and effort involved in fitting the runner device with extra fittings. Integrating a climbing aid in the running surface of the runner device in this manner makes it easier and more comfortable for a user to move forward with runner devices on surfaces such as snow, for example, and the device is of particular advantage in runner devices designed for special applications, such as a cross-country skis or touring skis, whereby a forward movement or acceleration is effected by a motion sequence, for example skating or by the user pulling ahead and pushing back a respective runner device. Providing the device in the top surface can improve the manipulation of runner devices when carried in the hands of the user because the adhesion between the hands of a user gripping the runner devices and the top surfaces is significantly improved, thereby enabling runner devices to be transported safely and with less effort.

Another advantage is the fact that the device has at least one active element which can be displaced so as to engage with the surface directed towards the running surface or top surface, especially in an active position, and/or the at least one active element of the device is provided in the form of a projection disposed at least partially in one of the recesses so that when the active elements engage with a surface directed towards the running surface or top surface, friction between the runner device and the surface is increased and/or a clawing effect of the active elements with the surfaces occurs, increasing slipping resistance, and the active elements can be disposed directly in the top layer and on the running layer.

The advantage of one practical embodiment of the board-type runner device, in which the device has an operating mechanism for switching the device from a passive position, in particular an inactive position, into an active position to increase slipping resistance, and/or from the active position into the passive position, is that the device can be fixed in an active and passive position by means of an operating mechanism, so that slipping and friction resistance at the top and/or running surface is increased only as and when necessary and the intrinsic sliding properties of the material used for the top layer and the running layer prevail unaltered in the passive position.

Also of advantage is another embodiment of the board-type runner device in which, when the device is in the active position, at least one region of the projection stands proud of the running surface of the running layer or the top surface of the top layer by a certain amount because the contact established between the projection and a surface directed towards it provides an easy means of increasing slipping and friction resistance.

In another embodiment of the board-type runner device, at least one recess along an external surface extends through a thickness of the top layer or the running layer, and in particular is provided as an orifice, the advantage of which is that a ski interior is rendered accessible through the recess via a running layer incorporating orifices which is easy to produce, and projections connected to components of the ski interior can be placed at least partially inside the recesses.

It is also of advantage to provide at least one housing compartment for an insert part between the top layer and the running layer of the runner device, and/or the housing compartment is bounded by the internal surface of the running layer or the top layer and a boundary surface, for example of a core element or a top or bottom belt, and/or the housing compartment merges into at least one of the recesses extending through the thickness of the top layer or running layer, because an insert piece can be disposed in the runner device in the housing compartment and the housing compartment is expediently disposed between the top layer and running layer, as a result of which the device with the active elements for increasing slipping and friction resistance can be easily accommodated in the housing compartment and recess of the runner device.

In another embodiment of the board-type runner device, the device comprises an insert piece disposed at least partially in the housing compartment, which forms at least one active surface on an active element which increases friction and slipping, in particular an active section, the advantage of which is that the at least one active surface of the insert piece designed to enhance friction and slipping resistance can be used to obtain the effect of the climbing aid or can facilitate carrying and handling due to the intermittent contact thereof with a surface directed towards it.

The at least one insert piece has a substantially plate-shaped basic body extending flat underneath the top layer and/or the running layer and/or it extends into at least one housing compartment via at least one of the recesses opening into the housing compartment, and/or the insert piece is of an integral design and extends so that it spans several recesses, the advantage of which is that the insert piece is secured to the runner device and is prevented from unintentionally working loose and may optionally be disposed close to the top layer or the running layer, in particular underneath the latter, and hence close to the active region of the insert piece at the top or running surface.

The at least one projection is disposed on the at least one insert piece and the distribution of the projections essentially corresponds to the distribution and/or contour of the projections formed by the side faces in the substantially peripheral contour of the recesses, and/or the projections extend from an abutment surface of the insert piece in the direction towards the running surface or top surface into the recesses, the advantage of which is that the insert piece is designed so that the disposition of the projections essentially matches the distribution or disposition of the recesses so that projections line up with the recesses in the top layer and running layer.

Advantage is to be had from one embodiment of the runner device in which the device is disposed in a binding mounting region of the runner device, in particular in the end region of the binding mounting region facing the ski tip, because this means that the device will essentially be disposed in the support region for a shoe on the binding of the runner device and the device can therefore be used as a means of introducing force into this region, for example so that the climbing aid can be automatically activated in the binding region by a weight distribution or weight shift or as a result of impact forces of a user. It is also of advantage to dispose the carrying or handling aid in this region because runner devices are usually taken in the hand and picked up by the binding mounting region or the region just in front of binding mounting region and this process will now be facilitated.

In one embodiment of the board-type runner device, the insert piece is provided in the form of an elastically flexible and rebounding element, which is also of advantage because the insert piece is able to deform, causing the active elements to be displaced out of the recesses, where the active surfaces can impart increased friction and slipping resistance, and this displacement counteracts a resistance force or return force but this will subside when the insert piece is restored to the initial shape or initial position, thereby obviating the need for additional return mechanisms.

The recesses with the projections extend across a longitudinal section in a lattice pattern and/or the running layer and/or at least certain regions of the top layer are of a lattice-type design, especially within the longitudinal section, and/or webs extend between the recesses which bound the recesses at their external surfaces, the advantage of which is that it enables an effective higher slipping resistance to be obtained over a large surface area in the longitudinal section but this region will nevertheless have good running properties at the running layer when in the passive position due to the lattice-type structure or webs.

In another embodiment of the board-type runner device, the top layer and/or the running layer is mounted so as to be at least slightly displaceable in the direction towards the interior, at least in the longitudinal section or an operating zone, the advantage of which his that the operating mechanism can be provided directly by the top layer and/or the running layer and, when sufficient force is applied, the top and/or running layer will be displaced, in particular deformed, so that the insert piece is displaced, whereby the insert piece is transferred from the passive position into the active position.

In other embodiments of the board-type runner device, the material of the at least one insert piece has a modulus of elasticity which is lower than a modulus of elasticity of the material used for the running layer and/or the top layer and the material from which the core-side boundary surface of the housing compartment, and/or the at least one insert piece is made from an elastically deformable material, preferably a plastic, such as an elastomer, for example, and/or the at least one insert piece is designed so that it can be at least partially forced out of the housing compartments and/or recesses in the direction towards the running surface of the running layer or the top surface of the top layer, and/or the active surfaces of the projections can be temporarily displaced due to the material moved of the recesses or housing compartments, the latter being formed by raised areas on the running surface and/or the top surface in the active position, the advantage of which is that the insert piece is made from a softer material than the surfaces surrounding and bounding it, in particular the housing compartments and recesses, so that when pressure is exerted on them, the surfaces bounding the insert piece are deformed onto at least certain regions of the latter and at least part-sections of their projections are forced out of the recesses enabling the active surfaces of these projections to be moved into an active position in which they enhance friction and slipping resistance.

In other embodiments of the board-type runner device, the device has a thrust element, in particular a thrust plate, which is actively connected to the operating mechanism and/or the thrust element displaces the active elements, in particular the projections, into the active position when a thrust force acts on the thrust element, in particular when the operating mechanism is operated, which is also of advantage because only one thrust element needs to actively co-operate with the insert piece and the active elements can be displaced into the active position when the thrust element is displaced.

In other embodiments, the insert piece is provided in the form of a hollow body with a variable volume and a housing compartment of the hollow body can be or is filled with a medium, in particular a fluid or gas, the advantage of which his that because the insert piece is a hollow body of variable volume, the cavity of the hollow body can be filled to increase its volume, thereby causing at least its active elements to be transferred out of the housing compartments or recesses so that they stand proud of the running and/or top layer. Using fluid or gas as a medium offers a simple way of varying the volume via inlet and outlet orifices.

In another embodiment of the board-type runner device, at least two different devices, in particular insert pieces, are linked to one another in displacement via a connecting element, the advantage of which is that several inset elements can be displaced by the connecting element irrespective of motion, and the active and passive position at the top layer and at the running layer are dependent on one another due to the coupled motion of the different devices so that only one operating mechanism is needed for several insert pieces.

In other embodiments, the operating mechanism is provided in the form of a top layer and/or running layer which is displaceable or flexible in the region of an operating zone and/or the top layer and/or the running layer is cambered, in particular convex, in the direction remote from the interior, and is preferably elastically flexible in the direction towards the interior, the advantage of which is that the operating mechanisms are the top layer and/or running layer themselves, obviating the need for additional components or mechanisms and, when forces act on the cambered region, less force is needed to displace the top layer and/or running layer due to the fact that the top layer or running layer is outwardly cambered.

Advantage is to be had from another embodiment of the board-type runner device in which the core element in the region of the operating zone is a separate component which can be displaced relative to the rest of the core element, because motion or force can be transmitted through the interior of the runner device via a displaceable core component so that thrust forces acting on the top layer, for example, can be transmitted to the device co-operating with the running layer.

Also of advantage is another embodiment of the board-type runner device in which the at least one insert piece has a gripping surface which is preferably gripped by a user and has a coefficient of static friction which is higher than a coefficient of static friction of the top surface of the top layer, and/or the at least one insert piece has a surface roughness on its gripping surface which is more pronounced than the surface roughness of the top surface of the top layer, because the higher coefficient of static friction and/or the more pronounced surface roughness on the gripping surface of the runner device makes it much easier for a user to hold this region and requires less force, and such runner devices are much safer and much more comfortable to carry. Another advantage is the fact that only the gripping surface need have an improved coefficient of static friction and the insert piece can therefore be finished with a surface finish or surface treatment or prepared with a separate surface coating accordingly.

An advantage is obtained due to the fact that the at least one insert part is provided in the form of a surface inset with a gripping surface which can be placed in contact with the surface, at least when necessary, and/or the gripping surface of the surface inset at least partially replaces the top surface of the top layer, and the surface inset is recessed in the top surface of the top layer and/or the recess is provided in the form of a groove, in particular an indentation, in the top layer or running layer and the insert part, in particular the surface inset, is secured at a surface region to the groove surfaces by an adhesive compound, for example, in particular a bonding compound, as a result of which friction and slipping resistance at the top layer can be increased by a surface inset incorporating a gripping surface in the top layer by very simple structural means.

In another embodiment of the board-type runner device, the gripping surface of the insert piece extends flush with the top surface of the top layer and/or the running surface or is set back from it, the advantage of which is that resistance to friction and slipping can be increased without the need to provide any elements standing proud of the top layer, thereby avoiding anything which might impair the aesthetic design of a runner device.

In yet another embodiment of the board-type runner device, the operating mechanism has at least one operating element and when the operating element is activated, the device can be positioned in the active position, the advantage of which is that the active and passive position of the device in the runner device can be fixed by the operating element and an active mechanical connection between the operating element and the active elements enables the latter to remain in the active or passive position irrespective of prevailing stress or forces which might be acting on the runner device. Another advantage is the fact that the user can activate and deactivate the position he desires using the operating element, and the operating element is provided in the form of a switch type handle, for example, which can be operated using a ski stick, for example.

BRIEF DESCRIPTION OF THE DRAWINGS

The invention will be explained in more detail below with reference to examples of embodiments illustrated in the appended, simplified drawings. Of these.

DETAILED DESCRIPTION OF PREFERRED EMBODIMENTS

Figure 1:
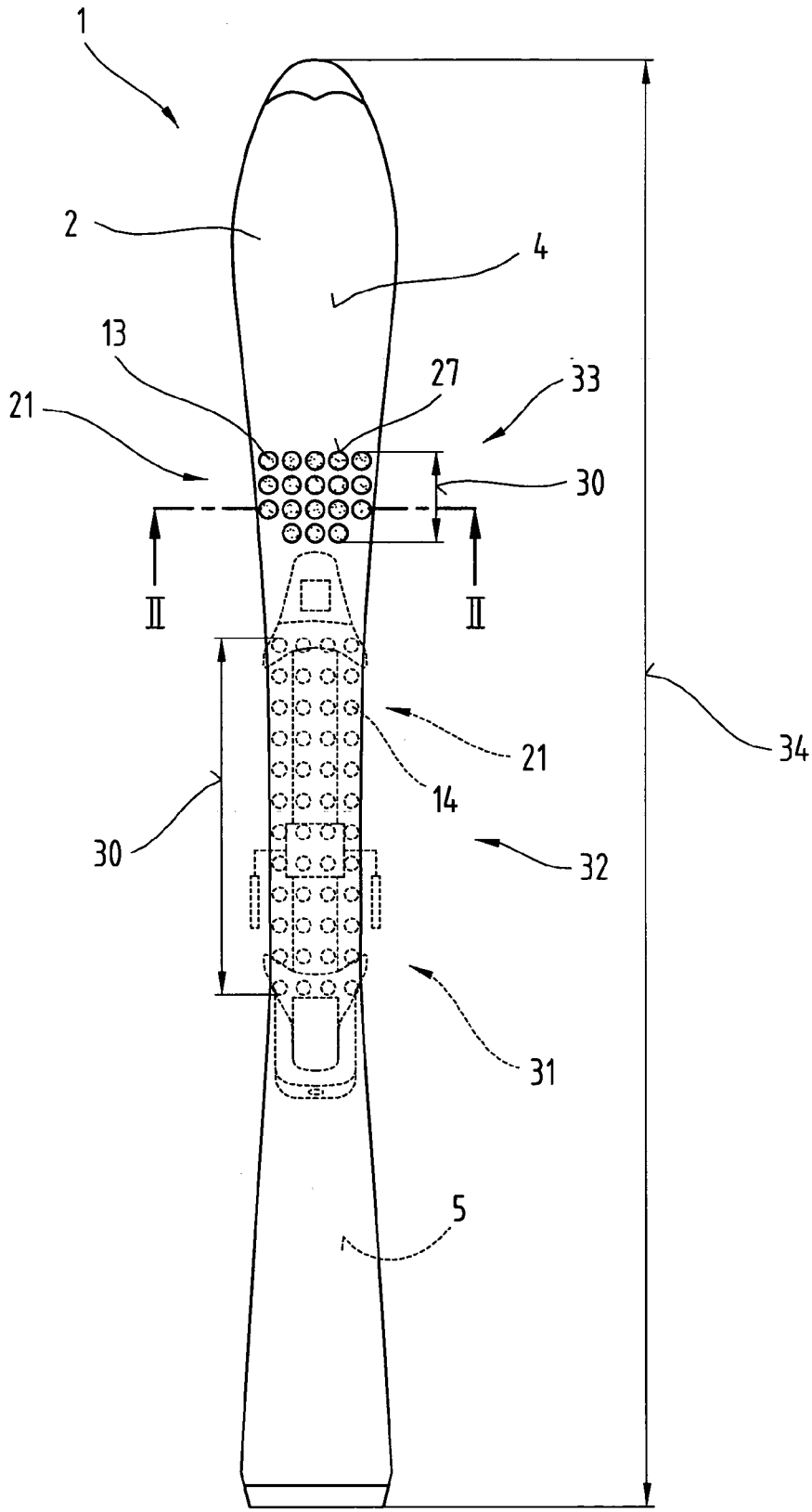
FIG. 1 is a simplified, schematic plan view illustrating a board-type runner device as proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
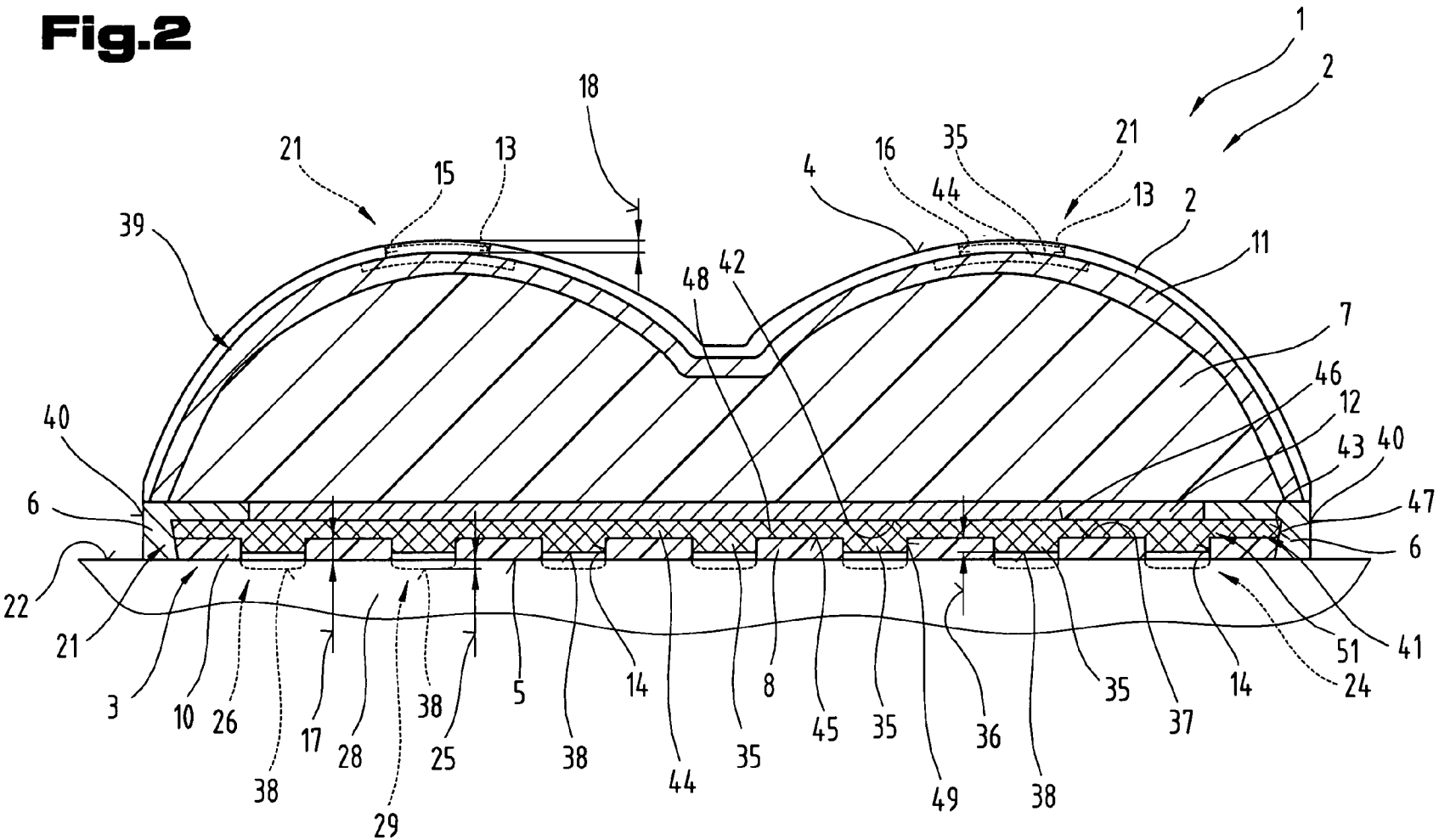
FIG. 2 shows the runner device illustrated in FIG. 1 along line II—II indicated in FIG. 1.

FIGS. 1 and 2 illustrate a board-type runner device 1, which has a top layer 2, with a running layer 3 lying opposite it. On the side remote from the running layer 3, the top layer 2 has a top surface 4, and the running layer 3 has a running surface 5 on the side remote from the top layer 2.

The basic structure of board-type runner devices 1, in particular ski-type apparatus, is already well known from the prior art, and a more detailed description of the individual components and structural parts will therefore not be given. FIG. 2 illustrates an example of a standard structure used for a runner device 1, in which the runner device 1 has, in addition to the top layer 2 and the running layer 3, two edging elements 6 and a core element 7. The core element 7 may in turn be made up of and/or surrounded by several layers, such as a multi-layered timber core, a supporting top belt and/or a supporting bottom belt for strengthening the runner device 1, for example.

The top layer 2 and the running layer 3 may also be made up of several layers or belts. However, the running layer 3 has at least one running surface layer 10, which is disposed adjacent to a bottom belt 11, for example. The running layer 3 may or may not also comprise several parts, for example a multi-part running surface layer 10. On the face remote from the top layer 2, the running layer 3 forms the running surface 5 by which the runner device 1 comes into contact with a surface, for example a snow surface, when in the operating state and glides along it.

The top layer 2, which is made up of the top surface 4 forming the outer surface of the runner device 1, may also be disposed adjacent to a supporting top belt 12 and the top layer may also be provided in the form of a composite part comprising a plurality of individual parts.

The different parts or layers of the runner device 1 may be joined to one another by a joining process known from the prior art and can therefore be adhesively joined to one another by filler or adhesive layers, for example.

Generally speaking, the runner device 1 may be used in applications for skis or snowboards and the present invention has proved to be of particular advantage if used for a cross-country ski or touring ski, in particular to enable a user to effect a forward movement, but may naturally also be used for an alpine ski.

The top layer 2 and/or the running layer 3 each have one or more recesses 13, 14. The recesses 13, 14 are provided at least in the top surface 4 and/or the running surface 5 and extend through an external surface 15, 16 in the direction of the core element 7.

One or more recesses 13, 14 may be provided respectively in the top layer 2 and in the running layer 3 and in the case illustrated in FIG. 2, for example, the recesses 14 provided in the running layer 3 may extend through a total thickness 17 of the running layer 3, and the recesses 13—indicated by broken lines—in the top layer 2 extend through a thickness 18 of the top layer 2, in which case the recesses 13, 14 may be provided as orifices in the running layer 3.

At least one of the recesses 13, 14 is fitted with a device 21 which may be disposed on the running surface 5 and/or top surface 4 to increase slipping resistance if necessary. In the embodiment illustrated as an example in FIG. 2, only the device 21 associated with the running layer 3 is illustrated in detail, although the device 21 may be provided also for or only for the top layer 2—as indicated by broken lines—and, this being the case, the functional aspects of the device 21 described here may be applied in the same way to the recess 13 disposed in the top layer 2.

The device 21 is designed so that the slipping and friction resistance at the external surfaces of the top layer 2 and/or the running layer 3 can be increased, at least in the region of the recesses 13, 14. A surface 22 in contact with the running surface 5 forms the support surface for the runner device 1 on a ground material, in particular snow, so that when the device 21 is in an inactive passive position 23, the running surface 5 of the runner device 1 is able to move along the surface 22 with what is preferably a very low slipping resistance. If necessary, however, the slipping resistance at the running surface 5 can now be increased, in order to prevent any unintended slipping.

In addition to the passive position 23 of the device 21, FIG. 2 has broken lines indicating an active position 24 of the device 21, in which the slipping resistance at the running surface 5 is significantly increased.

In the active position 24, the device 21 extends at least partially across an amount 25 along the running surface 5 in the direction towards the surface 22, as a result of which the slipping properties of the runner device 1 are limited by raised areas 26 on the running surface 5 which engage in the surface 22 and therefore increase slipping resistance along the surface 22. The raised areas 26 are provided in the form of elements which project into the surface 22 in a clawing arrangement, thereby causing a braking action, in particular a clawing effect, of the device 21 in contact with the surface 22. In the active position 24, therefore, the slipping properties of the running surface 5 are impaired due to a change in the surface structure at the running surface 5, where one or more raised areas 26 may be provided as necessary in certain regions. By forcing or compacting a material 28, in particular snow, the raised surface regions cause a reduction in the gliding speed of the runner device 1. The gliding properties of the runner device 1 are also impaired by the raised areas 26 because of an increased coefficient of friction between surface 22 and the running surface 5, in other words the slipping friction coefficient is higher when the device 21 is in the active position 24 than it is in the passive position 23.

When the device 21 is in the active position 24, therefore, at least one active element 29, preferably in the form of a raised area 26, is positioned so that it engages with the surface 22 directed towards the running surface 5, the effect of which is to increase gliding resistance.

As illustrated in FIG. 1, the device 21 preferably extends along a longitudinal section 30 of the runner device 1 and several devices 21 may be provided in the top layer 2 and/or in the running layer 3. As explained above, it would also naturally be possible for the device 21 described above used as a means of increasing gliding resistance at the running surface 5 to be provided in a similar manner in the top layer 2, the difference being that the slipping resistance between the top surface 4 and a gripping surface of a hand of a user applying force to the top surface 4 is increased, as will be explained later on in the description.

The longitudinal section 30 incorporating the device(s) 21 is preferably disposed in a binding mounting region 33 or directly adjacent to a binding 31, provided as a means of accommodating a user's shoe. The advantage of disposing the devices 21 in the region of a binding 31 is that the device 21 can be easily activated if necessary by a distribution of force which can be defined by a user, for example by applying a more pronounced force at a point in a force-transmitting region 32 which preferably lies within the longitudinal section 30, i.e. to place the device 21 in the active position 24. Another reason why it is of advantage to dispose the devices 21 on the top layer 2 in the region of a binding 31, in particular in a gripping region 33 just in front of the binding 31, is that a user can pick up the runner device 1 with his hands in the usual way but the increased slip resistance at the top surface 4 will make the runner device 1 much easier and more comfortable to carry.

It would naturally be possible for the longitudinal sections 30 in which the devices 21 are incorporated to extend across broad regions of the runner device 1, for example across the entire length 34 of the running surface 5, in particular across half or two thirds of a length 34 of the runner device 1, and/or several mutually spaced devices 21 extending respectively across a longitudinal section 30 may be provided in the top layer 2 and/or the running layer 3 and may be are arranged across the length 34 of the runner device.

The active elements 29 of the device 21 are expediently provided in the form of projections 35, extending at least partially into the recesses 13, 14 in the passive position 23. Such a projection 35 extending into one of the respective recesses 14 is illustrated in FIG. 2, the projection 35 preferably extending through a depth 36 from an internal face 37 of the running layer 3 in the direction towards the running surface 5. The projection 34 extending at least partially into the recess 14 is preferably designed so that its position can be moved so that an active surface 38 of the projection 35 can be displaced into at least one position flush with the running surface 5, preferably into the active position 24 in which the bottom dead centre of the active surface 38 projects out from the running surface 5 by an amount 25.

As mentioned, it is possible to provide several projections 35 disposed in different recesses 13, 14, each of which can be moved into a usage position in which the active surfaces 38 project from the running surface 5 by different and/or to a certain extent the same amounts 25. Consequently, in the region which is intended to have the effect of increasing braking and resistance to slipping, there may be projections 35 which stand out from the running surface 5 by a greater amount 25 than in a region where the resistance effect is not intended to be so pronounced.

The runner device 1 is preferably provided with a housing compartment 41 in an interior 39, bounded by the running surface 5, the top surface 4 and side faces 40. The housing compartment 41 may be bounded by at least the internal face 37 of the running layer 3 and another boundary surface 42, in which case the compartment may be closed off by adjoining end faces 43.

The boundary surface 42 may be provided directly on the core element 7, for example, in particular on the bottom belt 12, and the end faces 43 may be provided by means of a part of the core element 7 and/or a part of the edging elements 6.

As illustrated, it is of advantage if the housing compartment 41 incorporates at least one of the recesses 14, in other words the housing compartment 41 merges into the recesses 14, so that the external surfaces 16 form part of the surface bounding the housing compartment 41.

At this stage, it should be pointed out that the housing compartment 41 may also be formed between other components of the runner device, for example between two layers in the core element 7 or between one layer in the core element 7 and the top or bottom belt 11, 12, etc. However, care must be taken to ensure that the housing compartment 41 communicates with or can communicate with one or more of the recesses 13, 14 in the top layer 2 and/or the running layer 3.

As may also be seen from FIG. 2, the device 21 is preferably disposed in the housing compartment 41 so that the device 21 constitutes at least one insert piece 44. The at least one insert piece 44 has a bearing surface 45, by means of which the insert piece 44 sits against the internal face 37 of the running layer. The insert piece 44 is preferably also bounded by the end faces 43 and the boundary surfaces 42 so that a top peripheral surface 46 and a lateral peripheral surface 47 are in contact with the boundary surface 42 and the end face 43. By preference, the insert piece 44 therefore has a substantially plate-shaped basic body 48, which is laid flat in the interior 39 of the runner device 1, in particular in the housing compartment 41. The at least one insert piece 44 therefore extends across at least one of the recesses 14, so that this recess 14 is covered by the insert piece 44 in the open region directed towards the internal side 37, in particular so that the recess 14 is closed in this open region.

The insert piece 44 of the device 21 also incorporates the projections 35 constituting the active elements 29, which are preferably provided on a basic body 48 of the device 21 extending through the depth 36 into the recesses 14. The projections 35 are therefore preferably bounded at side faces 49 by the external faces 16 of the recesses 14, as a result of which the projections 35 in the embodiment illustrated as an example here have a peripheral contour matching that of the recesses 14.

It would naturally also be possible for the basic body 48 of the insert piece 44 to extend across several recesses 14, in which case an integral insert piece 44 is disposed in a housing compartment 41 encompassing several recesses 14 so that several projections 35 of an integral insert piece 44 each extend into different recesses 14. Another option is to provide several insert pieces 44 in the housing compartment 41, each of which extends across one or more of the recesses 14.

When the runner device 1 is assembled, the insert piece 44 disposed in the housing compartment 41 can be inserted in the runner device 1 so that it is then bounded around its entire periphery once the running and/or top layer 3, 4 have been joined to the other components of the runner device 1, for example. Accordingly, once the layers of the runner device 1 have been joined to form a composite piece, the insert piece 44 can be introduced into the housing compartment 41 subsequently, in which case a curable but preferably deformable material is introduced into the housing compartment 41 by injection or injection moulding.

Figure 3:
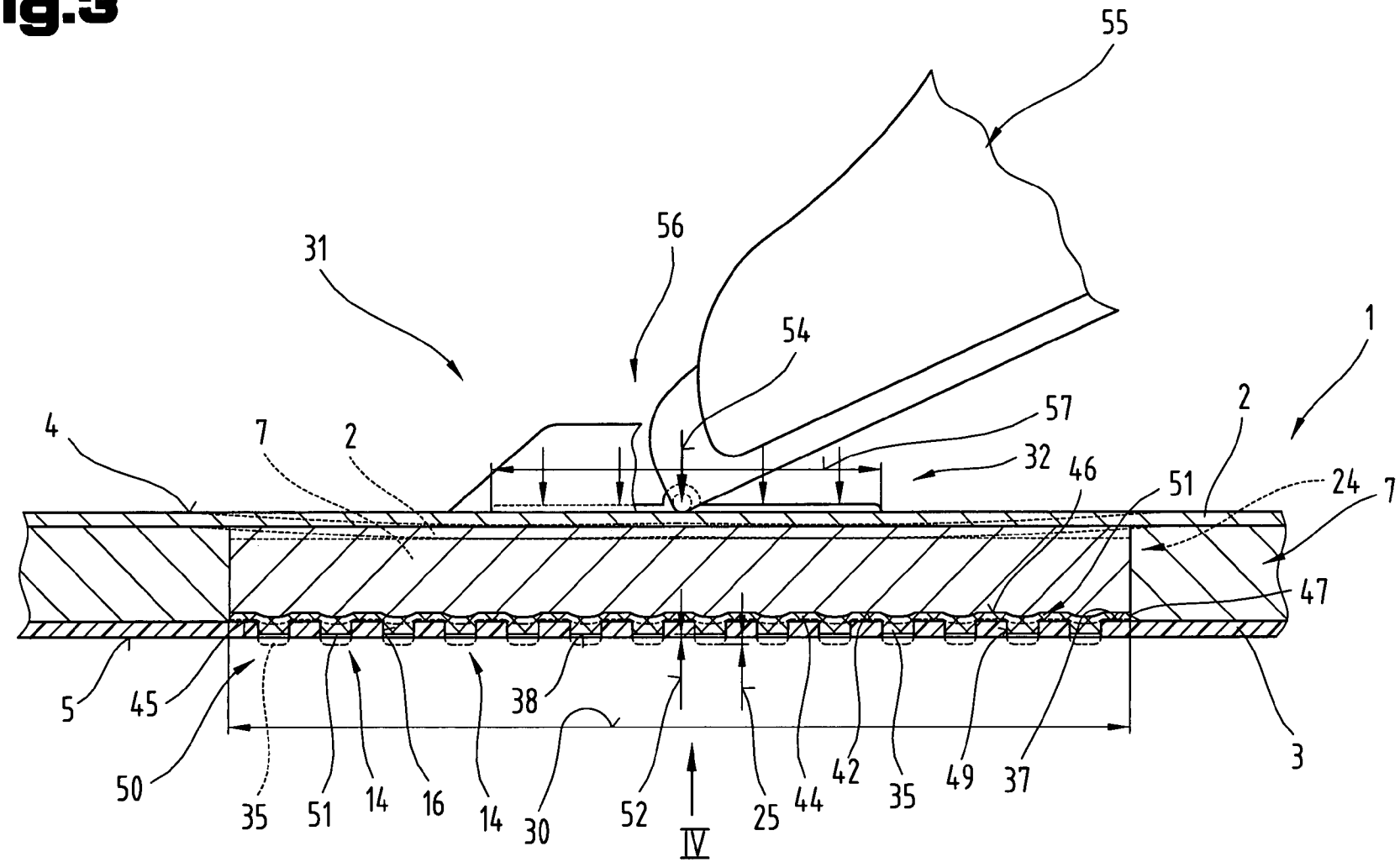
FIG. 3 is a longitudinal section showing another embodiment of the runner device proposed by the invention incorporating the device for increasing slipping resistance if necessary.

As may be seen from FIG. 3, for example, the running layer 3 and/or the top layer 2 may be provided in the form of a perforated sheet 50, in particular of a lattice-type design, incorporating recesses 14 with identical and/or having at least some differently shaped contours across a longitudinal section 30 of the runner device 1. The contours of the recesses 14 and/or projections 35 may be round, oval, or polygonal, for example, such as circular, square, trapezoid or lozenge-shaped, etc., or, as will be explained later on in the description in connection with FIG. 13, slot shaped, or may extend over a larger surface area across the entire longitudinal section 30. If the device 21 is provided by disposing the insert pieces 44 between the running layer 3, in particular the running surface 10, and a boundary surface 42, for example of the core element 7 or bottom belt 12, the projections 35 and active surfaces 38 of the device 21, which are displaceable relative to the running surface 5, in particular in a direction perpendicular thereto, can be relatively displaced in order to assume the active position 24.

In one particularly preferred embodiment of the at least one insert piece 44, the projections 35, in particular the active surfaces 38, can be moved or displaced due to the fact that the at least one insert piece 44 is made from a material with a modulus of elasticity which is lower than the modulus of elasticity of the materials from which the components bounding the insert piece 44 are made. In particular, the modulus of elasticity of the at least one insert piece 44 is lower than that of the material from which the running surface 5 and top surface 4 and the core element 7 are made, in particular the top belt 12 and bottom belt 11 at its boundary surface 42. The top and bottom belts 11, 12, which might be made from rolled steel or sheet steel for example, are made from a material with a high strength and rigidity, for example highly tensile plastic reinforced with glass fibre, metal alloys containing titanium, woven textile materials, leather, etc., in order to impart the best possible strength and elasticity properties to the runner device 1. The core element 7 may be made from a timber material or an expanded plastic such as polyurethane foam, for example. The running layer 3, in particular the running surface layer 10, and/or the top layer 4 are preferably made from a thermoplastic synthetic material. The insert piece 44 is preferably a flexible element 51 and is preferably made from materials with elastic properties, in particular from a material selected from the group consisting of elastomers, so that the material from which the insert piece 44 is made is preferably elastically deformable and therefore automatically expends a return force when subjected to force. The components forming the boundary surface 42 surrounding the insert piece 44 are therefore preferably made from a material with a greater hardness than the hardness of the material used for the insert piece 44. The transfer of the device 21 into the active position is therefore based on the interplay between a hard component pushing on a soft component, in particular the insert piece 44.

Since the insert piece 44 is elastic and provided in the form of a flexible, rebounding element 51, it can be at least partially displaced out of the housing compartment 41 and/or the recesses 14 in the direction towards the running surface 5 on the running layer 3 whenever the volume of the housing compartment 41 is reduced. It is therefore of advantage to completely fill the housing compartment 41 with the element 51 and to do so through the entire volume of the housing compartment 41, possibly with the exception of each recess 14 in the region of the free space in contact with the foreign surface extending between the running surface 5 and the active surface 38 spanning an amount 52 in the direction of the active surface 38. As a result of this design, when the volume of the housing compartment 41 in which the flexible element 51 is disposed is reduced, at least some of the material of the insert pieces 44 is displaced in the direction of the running surface 5 through the recesses 14, and, being elastic, a return force will oppose the reduction in volume, which will cause the insert piece 51 and volume of the housing compartment 41 to rebound automatically into the initial position.

In the embodiment illustrated as an example in FIG. 3, the insert piece 44 is a flexible element 51 made from a single piece of solid material with a low intrinsic friction and therefore retains its original volume of extension when displaced by pressure applied in certain regions or at certain points. Suitable materials for this purpose would be rubber materials selected from the group consisting of elastomers, plastics, gels, etc., for example, in which case these materials should be homogeneous and very tough. It would also be conceivable to provide a bag-like hollow body in the housing compartment 41, with a volume which may be expanded if necessary, for example by filling the cavity with a medium to vary the extension of a sleeve of the hollow body, as will be explained later on in the description (see FIG. 11).

So that the device 21 can be moved into the active position 24, it preferably has an operating mechanism 53. The broken lines indicated in the diagram of FIG. 3 illustrate how such an operating mechanism 53 works.

When a force or pressure is applied to the top surface 4, the runner device 1 or at least the region of the top layer 2 flexes. Due to the resultant force acting on the core element 7, the boundary surface 42 delimiting the housing compartment 41 moves in the direction towards the running layer 3, causing a reduction in the volume of the housing compartment 41. The flexible element 51 is therefore at least partially forced out of the recesses 14. In the embodiment illustrated as an example here, a split core element 7 is provided in the region of the longitudinal section 30, the separate core part of which can be displaced relative to the rest of the core element 7, making it easier for movement to be transmitted to the boundary surface 42, although it would naturally also be possible to provide the core element 7 as a single piece in the longitudinal direction of the runner device 1.

The projections 35 indicated by broken lines are therefore moved into the active position 24 in which the active surfaces 38 stand proud of the running surface 5.

Figure 4:
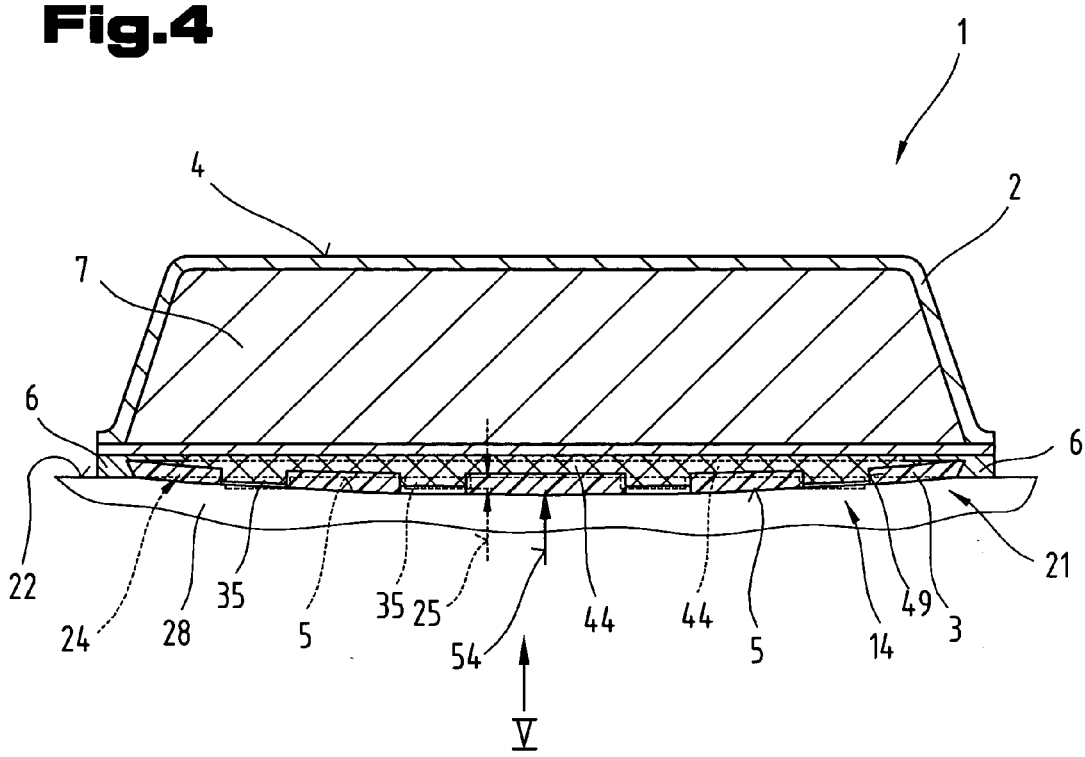
FIG. 4 is a diagram in cross section illustrating another possible embodiment of the runner device.

An example of a different embodiment of a runner device 1 with a device 21 incorporating an operating mechanism 53 is illustrated in FIG. 4.

In this case, the device 21 is designed so that when pressure is applied to the running surface 5 with a sufficient and, for example, definable, operating pressure, indicated by arrow 54 in FIG. 4, the running layer 3 or at least part of it, in particular the running surface layer 10, is able to move towards the core elements 7, causing the insert piece 44 to be displaced through the recesses 14 in the direction towards the surface 22.

The running layer 3 preferably has a convex camber in the longitudinal and/or transverse direction, extending in the direction remote from the top layer 2. The insert piece 44, in particular the flexible element 51, therefore lies against the internal face 37 with its bearing surface 45 along and directly on the concave curvature of the internal face 37 and is fixed so that it can not move or is rigidly bounded at the peripheral surfaces 46, 47 so that when force or pressure is applied to the running surface 5 in the direction of arrow 54 causing a displacement or movement of the running layer 3, the insert piece 44 is partially moved through the recesses 14 and out of them so that the projections 35 project at least partially out from the running surface 5 and the device 21 is moved into the active position 24. When the device 21 is in the active position 24, for example, the running surface 5 is essentially flat. Accordingly, the operating mechanism 53 is designed without any additional components due to the fact that the shaping, in particular the camber, of the running layer 3 makes it easier for the internal surface 27 to apply force to or exert pressure on the internal surface 37 on the insert piece 44 producing the projections 35, which are thus moved into the active position 24.

The camber of the running layer 3 preferably runs between the edging elements 6 and extends in the longitudinal direction of the runner device 1 across into longitudinal section 30 (see FIG. 1). Since this transverse camber of the running layer 3 is disposed in the region of a binding 31 and a support surface for a shoe 55, the force introduced into the running surface 5 as indicated by arrow 54 can be controlled by a user. The device 21 can therefore be used as a climbing aid or pushing aid due to the fact that better adhesion properties can be imparted to the running surface 5 in contact with surface 22 if necessary. Such a climbing aid is of advantage in situations when it is necessary to prevent the runner device 1 from slipping undesirably, for example if it is desirable to keep the runner device 1 stationary on a surface 22 with a gradient by exerting an increased or higher force on the runner device 1 with a shoe 55 of a user, in particular when pushing or going uphill. During such an ascent or descent, the heel region of a shoe 55 is raised and—as illustrated in FIG. 3—force is transmitted to a particular spot or region in a force-transmitting zone 57 on a support region 56.

This force applied by a user naturally also works in the same way on the running surface 5, and if the user applies enough force or pressure in the direction of arrow 54 to a force-transmitting zone 57, the running layer 3 will be deformed in the direction towards the flexible insert piece 44 as with the embodiment illustrated as an example in FIG. 4, or the top layer 2 is deformed and pressure is transmitted via the interior of the runner device 1 as is the case with the embodiment illustrated as an example in FIG. 3.

Such a climbing aid or pushing aid will make the runner device 1 much more comfortable for the user. Particularly in the case of special designs of runner devices 1, such as cross-country skis or touring skis, the state of the art is such that it has been necessary to use either permanently profiled facings or extra external mechanisms as a climbing aid. As a result of the invention, however, the forces which occur following the usual motion sequences caused by a user shifting his weight and expending additional pushing forces, can be used to increase the adhesion of the running surface 5 temporarily and for the requisite time. This makes it easier to perform the motion sequences, thereby improving forward motion with the runner device 1, and the training effect on the user can be optimised. During normal operation of the runner device 1 with a uniform spread of forces across the entire support region of a shoe, for example when a user wants to effect a desired gliding motion, the device 21 is moved into an inactive passive position 23, in which the gliding properties of the running surface 5 correspond to those defined by the material or surface condition of the running surface 5 and there is no increased resistance to gliding.

Figure 5:
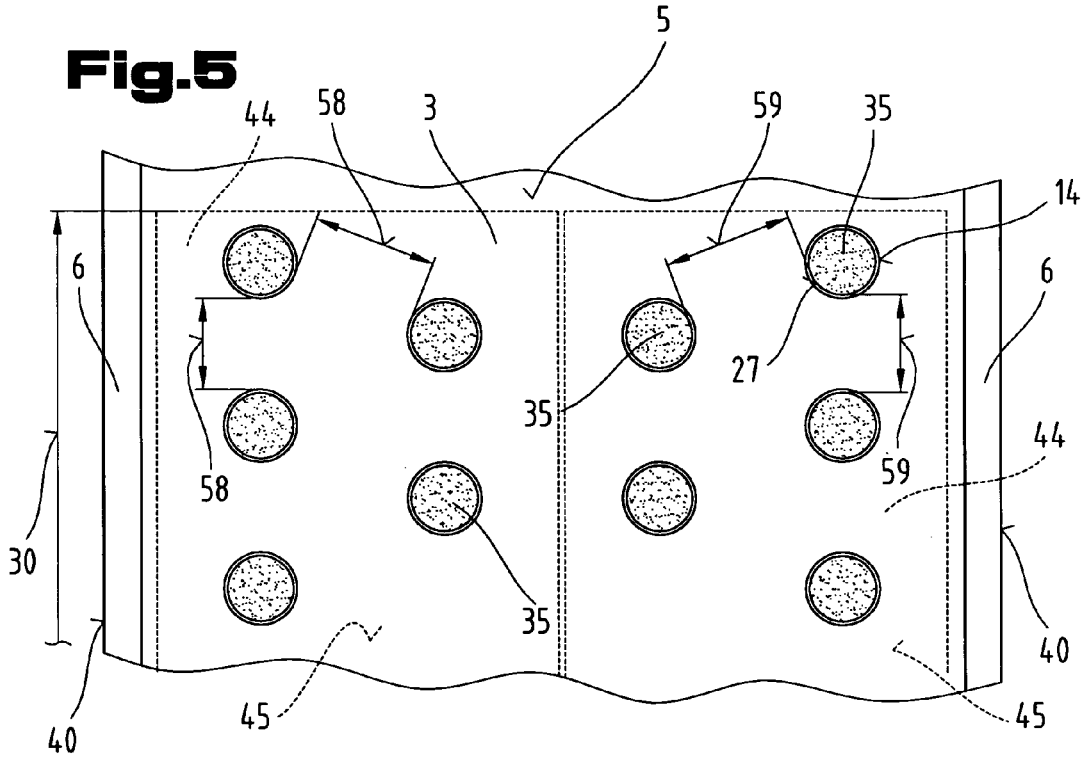
FIG. 5 shows another embodiment of a board-type runner device viewed from underneath as indicated by arrow V in FIG. 4.

FIG. 5 illustrates a view of a runner device 1 from underneath in the direction indicated by arrow 54 in FIG. 4. As illustrated, the insert piece 44 preferably extends across several recesses 14 in the running layer 3, and several recesses are preferably provided in the running surface 5. Also as illustrated, the projections 35 are also disposed on the bearing face 45 of the insert piece 44 extending in the direction towards the running surface 5 so that they line up with and locate in one of the recesses 14. This being the case, the contour 27 of a projection 35 respectively matches the contour of the external surface 16 of the respective recess 14. As may also be seen from the embodiment illustrated as an example in FIG. 5, the device 21 consists of several insert pieces 44 and in this particular case two.

The recesses 14 may be arranged in any pattern in the running layer 3 spaced at a distance 58 apart from one another so that the distances 59 between the projections 35 must essentially correspond to the distances 58 to enable the projections 35 to fit in the recesses 14. Due to the fact that the insert piece 44 extends across several recesses 14, it is also of advantage that any unintentional loosening of the projections 35 or parts of the insert piece 44 can be practically ruled out because the bearing surface 45 sits against the internal face 37 of the running layer 3 and it is not possible for the insert piece 44 as a whole to work loose through one of the orifices 14.

Figure 6:
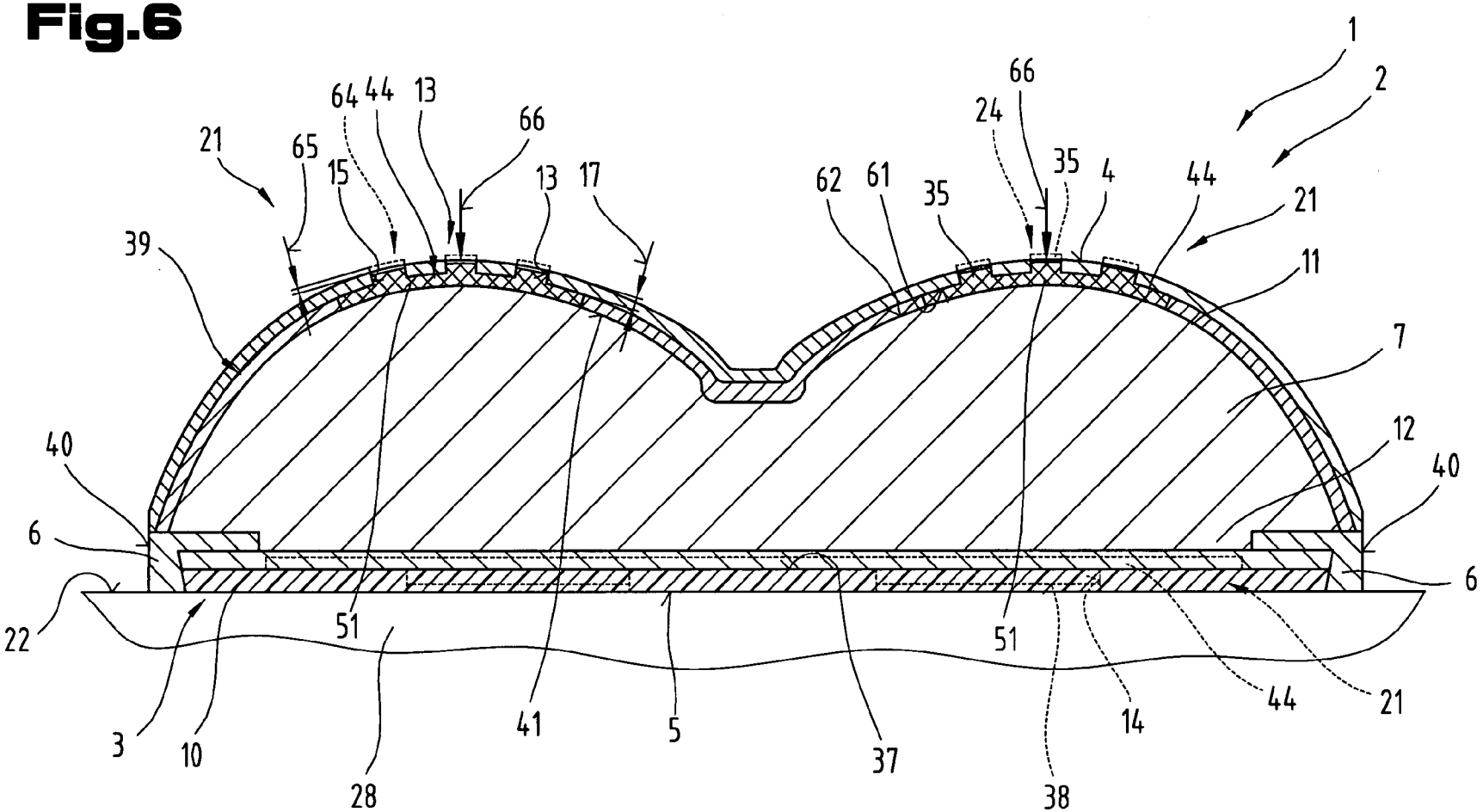
FIG. 6 is a cross section through another embodiment of a board-type runner device.

FIG. 6 illustrates a runner device 1 incorporating a device 21 but in this case the device 21 does not co-operate with the running layer 3 but with the top layer 2.

It should basically be pointed out that the operating principle of the device 21 disposed at the top layer 2 may essentially be the same as that of the device 21 described above in conjunction with the running layer 3. The one or more recesses 13 in the top layer 2, which are bounded by the external surfaces 15, extend as continuous orifices 17 through the thickness 17 of the top layer 2 in the embodiment illustrated as an example here and in turn preferably co-operate with a housing compartment 41 for an insert piece 44 provided in the form of a flexible element 51. The housing compartment 41 is therefore bounded by at least one internal face 61 of the top layer 2 and a boundary surface 62 of the core element 7, in particular the top belt 11. The housing compartment 41 may incorporate several recesses 13 or merge into them, in other words is open in certain regions due to the recesses 13.

At least one insert piece 44 is disposed in the housing compartment 41, which essentially corresponds to the insert piece 44 described above in connection with FIGS. 2 to 5. This results in a device 21 that is conducive to increasing slipping resistance on the top surface 4 of the top layer 2 if necessary. The increase in slipping or friction resistance in the preferred embodiment illustrated as an example here is again obtained by a displacement of the material of the insert piece 44 due to pressure applied to at least a part-region of the surface of the insert piece 44, in particular by reducing the volume of the housing compartment 41, as a result of which the projection or projections 35 are at least partially displaced out of the recess 13 in the direction towards the top surface 4 so that the projection 35 stands proud of the top surface 4 by a distance 65 in the active position 24.

The advantage of runner device 1 incorporating a device 21 on the top surface 4 is that when the insert element 44 is deformed under pressure applied to the top surface 4 as indicated by arrow 66, the top surface 4 becomes easy to grip and has a high slipping resistance. The force or pressure indicated by arrow 66 preferably acts within an operating zone spanned by the insert piece 44.

Figure 7:
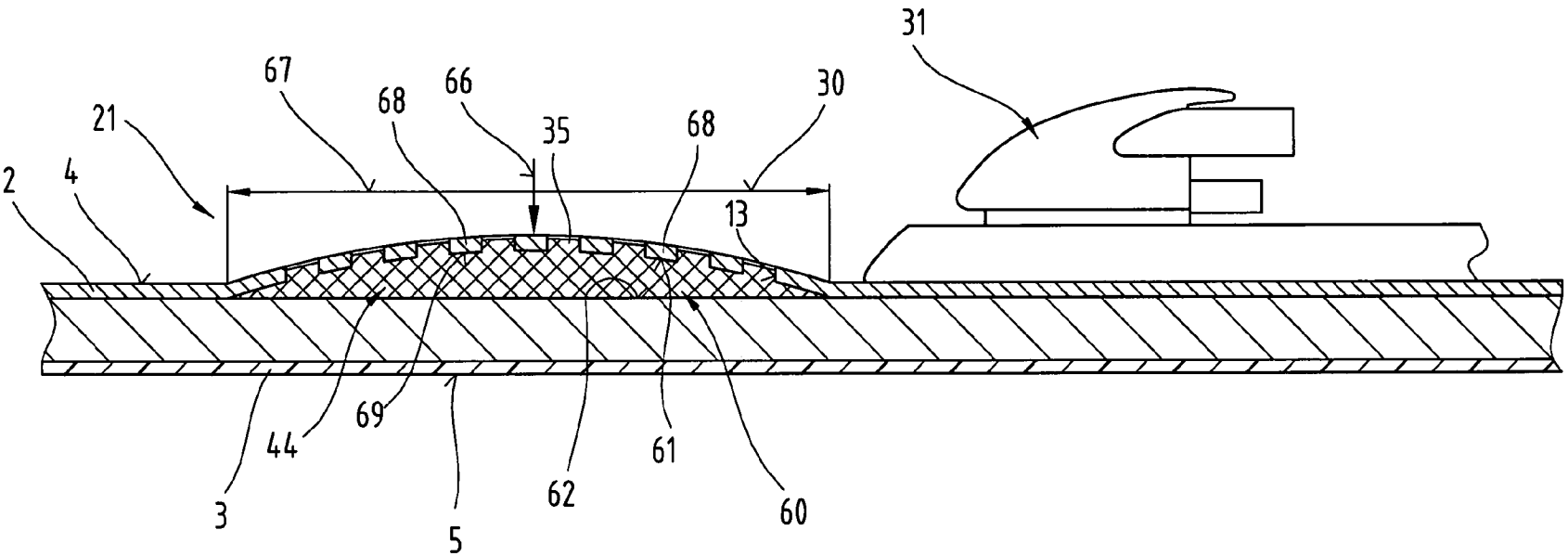
FIG. 7 is a longitudinal section through another embodiment of a board-type runner device.

FIG. 7 illustrates a device 21 used in conjunction with the top layer 2, viewed in longitudinal section, which extends across the operating zone 67 which is preferably disposed above a region which extends on the face directed towards the top of the runner device 1 across a longitudinal section 30 to just in front of a binding 31.

In the embodiment illustrated as an example here, the operating zone 67 in the top layer 2 is provided in the form of a perforated plate 50 which cambers outwardly on the top surface 4 of the top layer 2, in particular is convex in the direction remote from the running layer 3, and the housing compartment 41 with the insert piece 44 is disposed between the perforated plate 50, in particular the internal face 61, and the boundary surface 62.

The regions of the top layer 2 extending between the recesses 13 are provided in the form of webs 68, which sit against thrust surfaces 69 directed towards the interior 39 of the runner device 1 directly adjacent to the insert piece 44, and when force is applied to the perforated plate webs as indicated by arrow 66, the projections 35 are displaced into a position standing proud of the top surface 4 due to movement of the webs 68 relative to the regions of the top layer 2 disposed outside the operating zone 67. Consequently, the top layer 2 preferably has a lattice-type structure in the operating zone 67, which can be displaced in the direction towards the core element 7.

This significantly improves the handling of the runner device 1 by a user, who will find it mulch easier to pick up and carry the runner device 1 as a result of the projections 35 projecting out from the top surface 4 of the top layer 4 in the active position 24, in other words the top surface 4 is now profiled as a result of the raised areas 26, making it easier to grip and requiring less force. Carrying safety is also improved because the top surface 4 in the operating zone 67, which corresponds to the region by which the user normally takes hold is profiled, so that the top surface 4 will adhere to the hand or a glove of the user much better, preventing the runner device 1 from slipping out of the user's hand. It should be pointed out that the operating zone 67 may also run in other regions along the longitudinal extension 34 of the runner device 1 and need not be limited to the region in front of the binding 31 as illustrated, although this is of advantage because runner devices 1 are usually carried with the running surfaces 5 placed one against the other and then gripped by the user's hand just in front of the binding so that the rear part of the ski can be placed easily on the user's shoulder for carrying.

Figure 8:
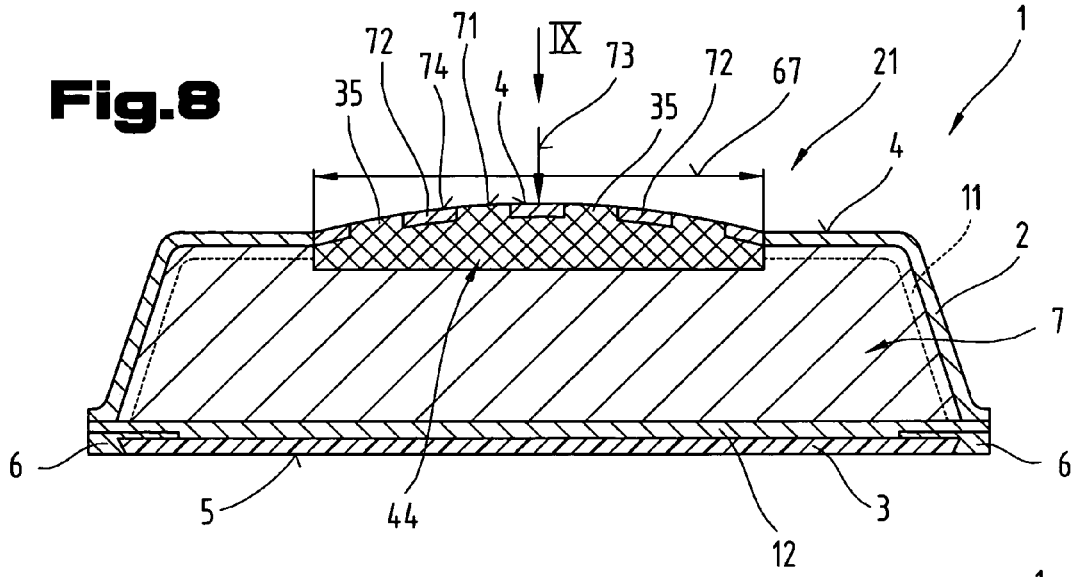
FIG. 8 shows another embodiment of the board-type runner device viewed along line VIII—VIII indicated in FIG. 9.
Figure 9:
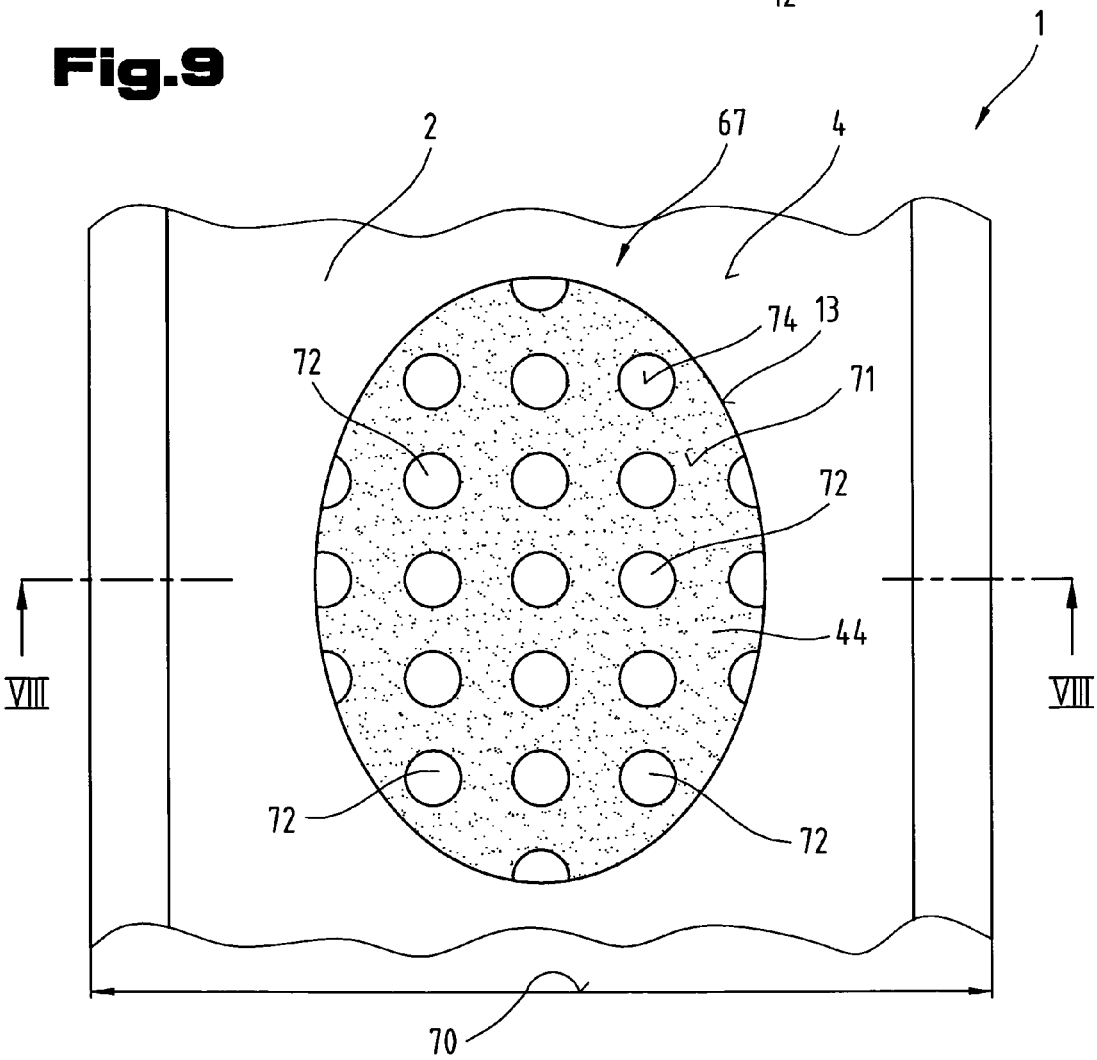
FIG. 9 shows the embodiment illustrated in FIG. 8 in a view from above, as indicated by arrow IX in FIG. 8.

FIGS. 8 and 9 illustrate another embodiment of a runner device 1 incorporating a device 21. An insert piece 44 is provided, again in the form of a flexible element, and co-operates with the top layer 2 so that the projections 35 can be made to stand proud of the top surface 4 in the operating zone 67 if necessary.

In the embodiment illustrated as an example here, a recess 13 is provided in the top layer 2 which extends across a broad width 70 of the runner device 1, for example more than 50%, in particular 75% or 50 to 90%, of the width 70. The insert element 44 disposed in the recess 13 is cambered at an external face 71, and is preferably outwardly convex, although it would also be conceivable for the external surface 71 in this example of an embodiment, as with the embodiments described above and below, to be flat or parallel with the top surface 4 in the region outside the operating zone 67. Specifically in the example illustrated here, however, an external face 71 with a cambered design is of advantage because when the external surface 71 is gripped by applying pressure, for example with the hand of a user, the projections 35 automatically stand out from the housing compartment 41*m* proud of the top surface 4, and there is no need to exert further pressure to displace the thrust surfaces 69 from a flat or level position.

As illustrated, thrust elements 72 are disposed in the region of the external surface 71 of the insert piece 44 but in the form of separate components which do not form an integral part of the top layer 2. The thrust elements 72 are expediently provided as rigid components made from a material with a higher modulus of elasticity than the material of the insert piece 44 so that when a pressure force as indicated by arrow 73 is directed onto a contact surface 74 of the thrust elements 72, the latter are moved in the direction of core element 7, causing the material of the insert piece 44 to be displaced above the level of the contact surface 74 or top surface 2 in the manner described above, so that the projections stand proud of the contact surfaces 74. The thrust elements 72 may be made as a composite part 75 together with the insert piece 44, in which case the thrust elements 72 may be adhesively bonded to the composite part 44. This approach offers an inexpensive device 21 of a very simple structure.

It should be pointed out at this stage that, generally speaking, when the device 21 is in the active position 24, the extra slipping or friction resistance is achieved due to a profiled design of the respective surface, in particular the top surface 4 and running surface 5, and in the passive position 23, this profiled surface is not available.

Figure 10:
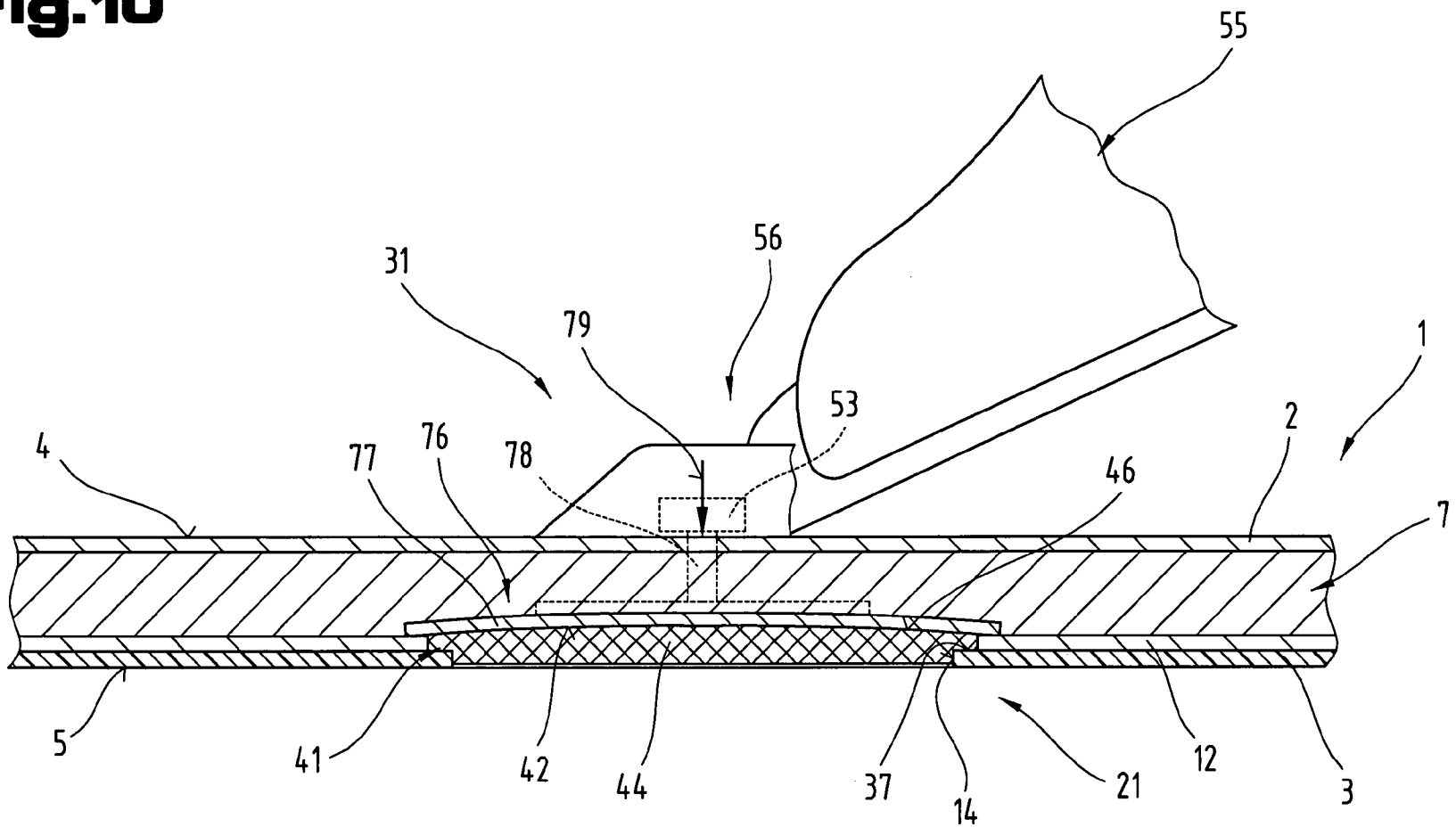
FIG. 10 is a longitudinal section through another embodiment of a board-type runner device.

FIG. 10 illustrates another embodiment of a device 21 incorporated in a runner device 1. Again, the insert piece 44 is provided in the housing compartment 41, which is bounded by the internal surface 37 of the running layer 3 and a boundary surface 42. The running layer 3 has a flat, level extension and preferably does not have a camber, so that the internal face of the running layer 2 is essentially rigid and not susceptible to variation. The insert piece 44 in this case is bounded at the external face 46 by the boundary surface 42 of a thrust element 76, in particular a thrust plate 77. The thrust element 76 is displaceable relative to the running layer 3 so that there is at least a partial movement of the boundary surface 42 in the direction towards the internal face 37, enabling the volume of the housing compartment 41 to be reduced in order to achieve the effect described above whereby the insert piece 44, made from a flexible, in particular elastic, material is pushed through the orifices 14 in the direction of the running surface 5.

As illustrated, the thrust element 76 is provided in the form of a thrust plate 77, at least certain regions of which can be displaced when force is applied. The thrust plate 77 is of a cambered design, for example, and can be moved under the action of force applied as indicated by arrow 79 so that it lies flat, whereby the volume of the housing compartment 41 can be reduced with very little effort by displacing the boundary surface 42. As illustrated, force can be transmitted to the thrust element 76 by means of a transmitter element 78, for example, which is moved as and when necessary in the direction of arrow 79, enabling the device 21 to be shifted into the active position 24. The transmitter element 78 used for this purpose might be a mechanical displacement linked to the operating device 53, for example, which co-operates with the binding depending on the position of a shoe transmitting a motion in the direction of arrow 79 so that a force is exerted on the thrust element, moving the latter in the direction towards the running layer 3. An operating mechanism 53 is indicated by broken lines and is linked to the transmitter element 78 in order to transmit movement and/or force. The operating mechanism 53 may also incorporate one or more activatable operating elements if necessary, by means of which the device 21 can be fixed in the desired position by the user, in particular the passive position 23 or the active position 24. The operating system may be mechanical, in which case switching elements will be linked to the transmitter element 78 and a transmitter element 78 linked to the shoe 55 by electromechanically, pneumatically or hydraulically displaceable transmitter elements 78, etc. Generally speaking, it should be pointed out that the active and passive positions of the device 21 can be fixed by the user by means of an operating element co-operating with the operating mechanism 53.

Naturally, it would also be possible to dispense with a transmitter element 78, in which case the requisite force or pressure on the external face 4 of the runner device 1 will be transmitted via the core, for example due to a slight deformation of the runner device 1 in this region, to the thrust element 76 and hence without the need for additional parts, in the same way as the force is used to act on the insert piece 44 described in connection with the preceding Figs.

Figure 11:
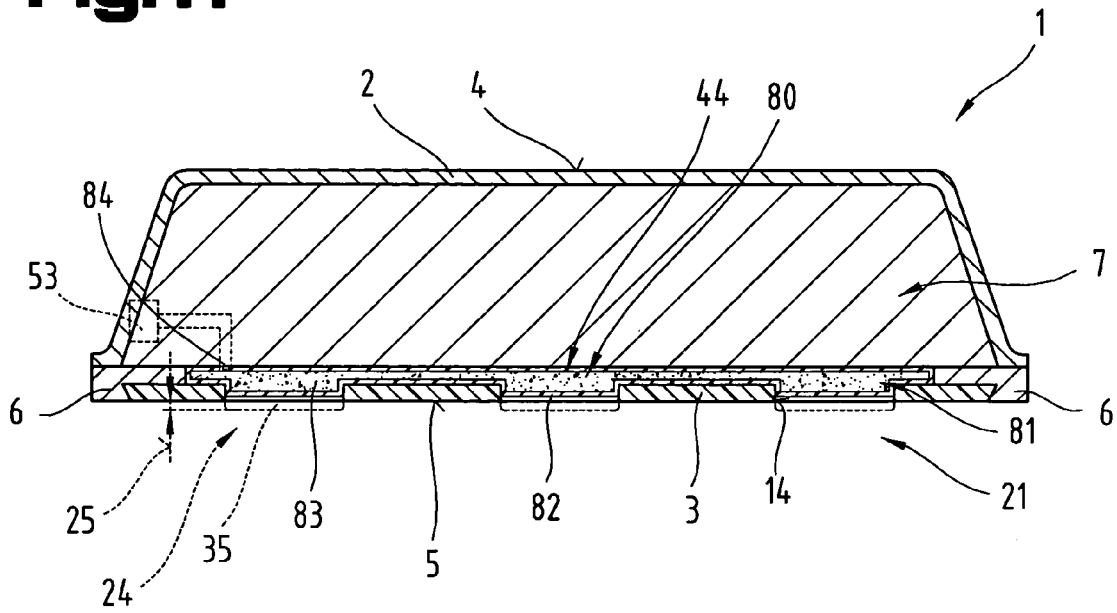
FIG. 11 is a cross section through another embodiment of a board-type runner device.

In the embodiment of a device 21 illustrated in FIG. 11, the insert piece 44 is provided in the form of a hollow body 80 bounding a housing compartment 81 by means of a casing 82. The hollow body 80 may be disposed in a housing compartment 41 corresponding to one of housing compartments 41 described above and preferably extends at least partially into the recesses 14. It is preferable if the hollow body 80 can be filled with a medium 83 so that the volume of the hollow body 80 can be varied at least in the region of the recesses 14 to the degree that the projections 35 are created and stand proud of the running surface 5 to enable the hollow body 80, in particular the projections 35, to move at least partly out of the recesses 13, 14 associated with the housing compartment 41 and stand out from the running surface 5, in particular the hollow body 80, by an amount 25 in an active position 24.

To this end, the hollow body 80, in particular the casing 82, is preferably made from a flexible or elastic material, which may be of a film type or collapsible, for example. The hollow body 80 may have an orifice 84 in the casing 82, for example, which is preferably fitted with a shut-off valve by which the housing compartment 81 of the hollow body 80 can be filled with medium 83, causing the volume of the hollow body 80 to expand. The medium used might be a gas, for example, such as air or fluid, in which case the hollow body 80 of the device 21 will be designed so that it can be pneumatically and/or hydraulically transferred into the active position 24 and the hollow body 80 of the device 21 is returned to the passive position by evacuating the housing compartment 81 of the hollow body 80, for example. The broken lines in FIG. 11 also indicate an inlet passage by which the housing compartment 81, in particular the orifice 84, of the hollow body 80, can be placed in flow communication or connected and actively linked to an operating mechanism 53 for introducing and evacuating the medium 83.

Figure 12:
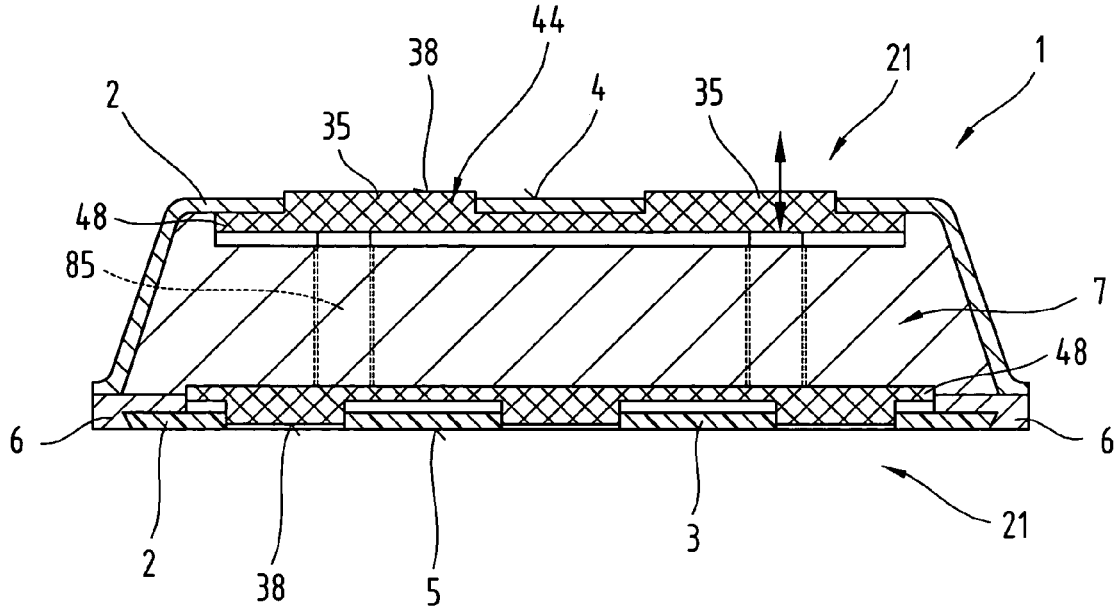
FIG. 12 is a cross section through another embodiment of a board-type runner device.

FIG. 12 illustrates another embodiment of a device 21 incorporated in a runner device 1. In this case, the insert piece 44 is a rigid component with non-elastic material properties. This being the case, the basic bodies 48 are linked in displacement to the projections 35 disposed on them by means of connecting elements 85, so that the projections 35 can be transferred to the usage position with only one moving or displacement element of the device 21 on the top surface 5 and the running surface 5, and the insert piece 44 can be positioned in a substantially neutral intermediate position in which the active surfaces 38 of the projections 35 are positioned flush with the running surface 5 or top surface 4.

In order to place the insert piece 44 in a specific position, the operating means used may be an operating mechanism 53 of the type described above, for example based on a force acting on the runner device 1 in the support region for a shoe 55.

However, in this particular embodiment, it is of advantage to use an operating mechanism 53 by means of which the position of the device 21 is definably fixed and immobilised by a user irrespective of the force applied by a shoe in the operating zone 67 so as to remain activated. As explained above, this may be done by a movement linked to a binding 31, whereby the devices 21 can placed in the active position and, if a certain binding position is not activated, into a passive position, irrespective of certain binding positions and or the position of an operating element of the binding, for example an activated climbing device in the heel region of a touring ski binding.

Figure 13:
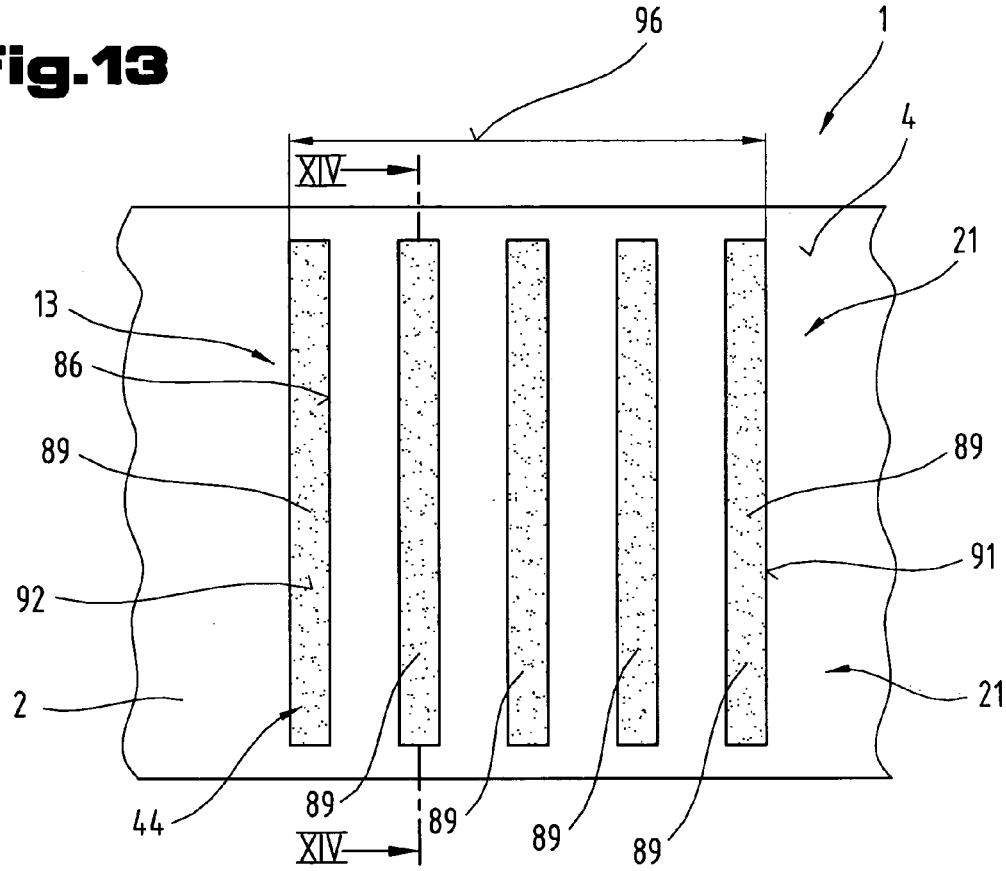
FIG. 13 is a plan view of another embodiment of a runner device.

FIG. 13 illustrates another embodiment of a runner device 1 with a device 21 at least partially incorporated in the top layer 2. The recesses 13 are provided in the top layer 2, which are merely indentations extending from the top surface 4 in the direction towards the core 7. The recesses 13 are therefore preferably provided in the form of grooves 86, the groove surface 87 of which, in particular a groove base, is disposed at a depth 88 in the top layer 2. One or more insert pieces 44 may be disposed in the grooves 13.

Figure 14:
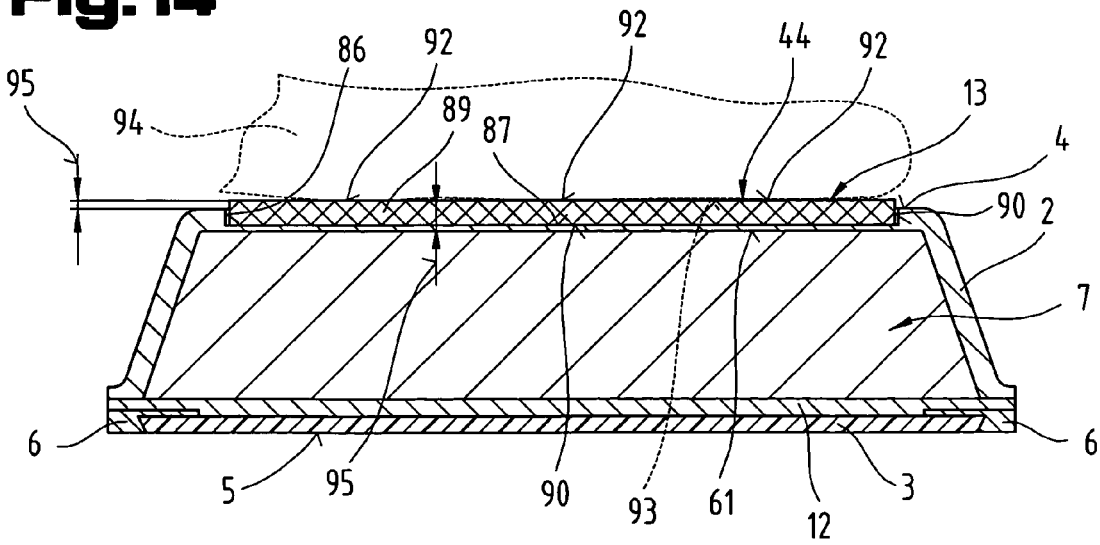
FIG. 14 shows the embodiment of a runner device illustrated in FIG. 13, viewed in section along line XIV—XIV indicated in FIG. 13.

The insert pieces 44 in the embodiment illustrated as an example in FIGS. 13 and 14 are surface insets 89, which are disposed in the grooves 26, at least partially set back from the surface region 90. The surface insets 89 are preferably bounded by the groove 86 within the runner device 1 along the entire peripheral contour 91 of the surface inset 90. The recessed surface region 90 may be at least partially affixed to the groove surface 87, in particular by adhesive bonding, such as glue for example.

The surface insets 89 each have gripping surfaces 92, disposed level with and spanning a part of the top surface 4 or form a part of the top surface 4, so that when these gripping surfaces 92 come into contact with a surface 93, which might be the active surface of a user's hand 94, for example, there is coefficient of static friction $\mu_0$ between the surface 93 and the gripping surface 92, even when a low force is normal force is acting on the gripping surface 92, which is greater than the coefficient of static friction $\mu_0$ between the surface 93 and the top surface 4. This can be achieved by a gripping surface 92 with a coefficient of static friction that is greater than a coefficient of static friction on the external face 4 of the top layer 2, at least in a region surrounding the surface inset. The device 21 and the surface insets 89 co-operating with it therefore increase slipping and friction resistance at the external face 5 of a runner device 1, thereby imparting the advantages described above, namely making the runner device 1 easier for the user to carry. The surface insets 89 may be made from a rigid, non-deformable material, which need have nothing more than an appropriate gripping surface 92 with a higher coefficient of static friction than the top surface 4 in the region of the device 21. As an example, it would also be possible for the surface insets 89 to be made from a hard compound with a surface coating to form the gripping surfaces 92 or the gripping surfaces 92 may be prepared by a surface treatment or surface finishing process to produce an increased coefficient of static friction.

It is of advantage if the gripping surfaces 92 stand proud of the top surface 4 or the top layer 2 by an amount 95, since this will make it very easy for a user to grip in his hand 94 and will be very effective. However, it would naturally also be possible for the gripping surfaces 92 to sit flush with the top surface 4 or the gripping surfaces 92 might be recessed in the grooves 86 by only a slight distance from the top surface 4.

As illustrated in FIG. 13, the recesses 13, in particular the grooves 86, are of a slot-type or rectangular design, as a result of which only a few insert pieces 44 need be provided in the recesses because of the large active surface available for increasing slipping resistance at the top face 4, in particular in a contact zone 96. Another possibility would be to provide surface insets 89 with a peripheral contour 91 that is round or oval, for example, as illustrated in the preceding drawings.

Figure 15:
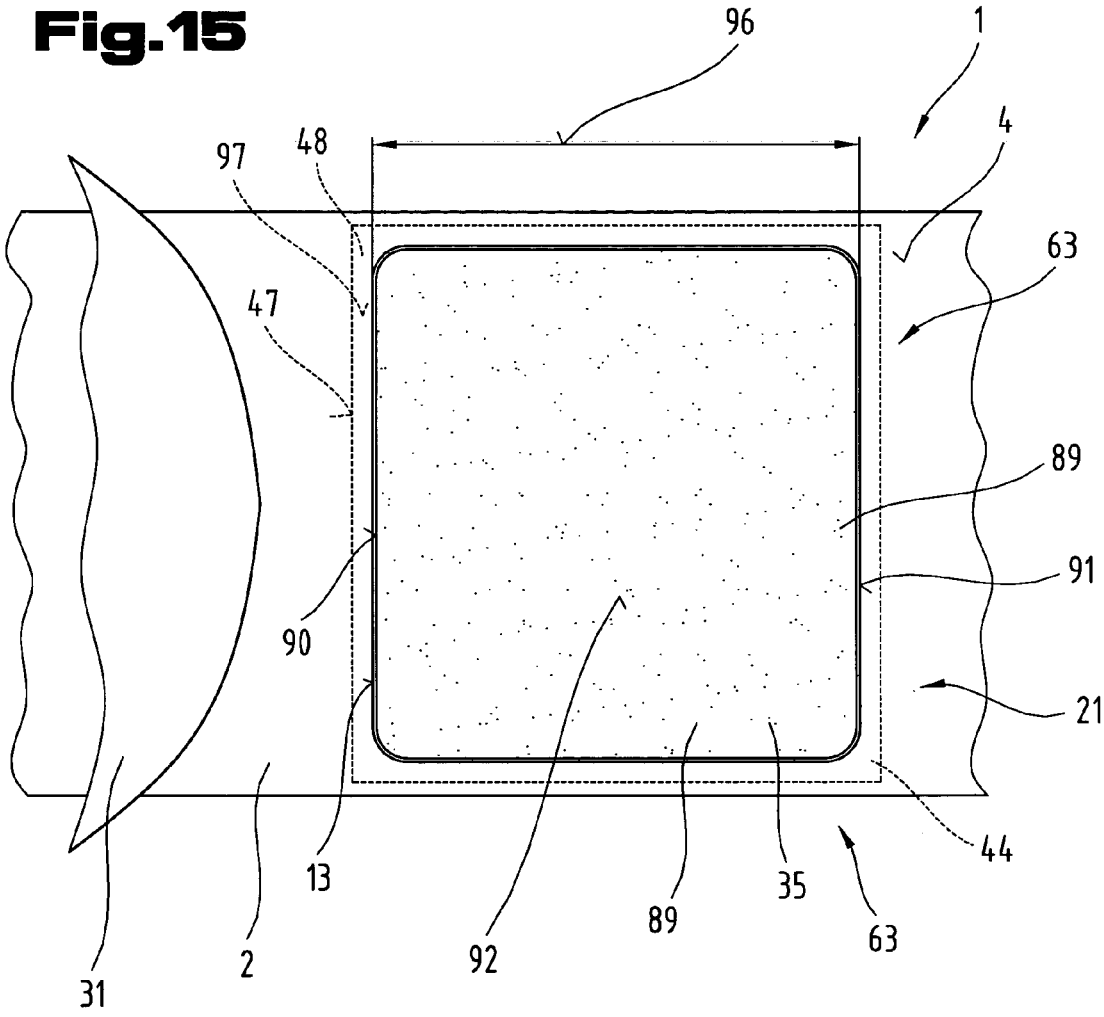
FIG. 15 is a plan view of another embodiment of a runner device.

Finally, FIG. 15 illustrates another embodiment of a runner device 1 incorporating a device 21 in the top surface 4 in order to increase slipping resistance, only one surface inset 89 being provided in the top layer 2 in this particular embodiment. It has a gripping surface 92, with is substantially an extension of the surface 93 which comes into contact with the top surface 4. The contact zone 96 in this case may extend in a region just in front of a binding 31, which will also offer the same advantages as those described above.

In the embodiment illustrated here, the top layer 2 has a recess 13 which extends through the entire thickness 17 (see FIG. 6) and the insert piece 44 has a basic body 48 on which the surface inset 89 is provided in the form of a projection or protrusion. The insert piece therefore has a bearing surface 97 which sits against the internal face 61 and in particular is affixed thereto, so that the insert piece 44 is also secured to prevent it from inadvertently working loose from the runner device 1.

The gripping surfaces 92 may also have a surface roughness, which is more pronounced than the surface roughness of the external surfaces, in particular the running surface 5 and the top surface 4 of the running layer 3 and the top layer 2, at least in a region surrounding the gripping surfaces 92. The greater roughness depth on the gripping surface 92 means that static friction between it and the surface 22, 93 in contact with it will be higher. The gripping surfaces 92 may also incorporate special structures, such as adhesive fibres, for example, in order to improve contact with a surface 22, 93.

It should generally be pointed out that the different variants of the device 21 and the different embodiments of the insert pieces 44 may be used in any combination on a runner device 1, so that a runner device 1 could have the device 21 in the running layer 3 as a climbing aid and another device 21 on the top layer 2 to facilitate handling and carrying.

Furthermore, the device 21 co-operating with the running layer 3 may also be provided with an insert piece 44 incorporating gripping surfaces 92 so that the slipping resistance between the running surface 5 and a surface 22 can be further increased.

The examples illustrate various different possible embodiments of the runner device 1 but it should be pointed out at this stage that the invention is not restricted to the embodiments illustrated here and instead, various different combinations of the individual embodiments may be mixed with one another, it being within the reach of the skilled person to use the teaching of the invention to obtain these various different options. Accordingly, all combinations which can be obtained from the individual detains are possible and the described embodiments all fall within the scope of the invention.

For the sake of good order, it should be pointed out that in order to provide a clearer understanding of the structure of the runner device 1, it and its constituent parts are illustrated to a certain extent out of scale and /or on an enlarged scale and/or on a reduced scale.

The individual solutions proposed by the invention and the related objectives may be found in the description.

Above all, the individual embodiments illustrated in FIGS. 1; 2; 3; 4, 5; 6; 7; 8, 9; 10; 11; 12; 13, 14; 15 may be construed as individual solutions proposed by the invention in their own right. The objectives and solutions proposed by the invention may be found in the detailed descriptions of these drawings.

List of Reference Numbers

1 Board-type runner device
2 Top layer
3 Running layer
4 Top surface
5 Running surface
6 Edging element
7 Core element
10 Running surface layer
11 Top belt
12 Bottom belt
13 Recess
14 Recess
15 External surface
16 External surface
17 Thickness
18 Thickness
21 Device
22 Surface
23 Passive position
24 Active position
25 Amount
26 Raised area
27 Contour
28 Material
29 Active element
30 Longitudinal section
31 Binding
32 Force-transmitting region
33 Binding mounting region
34 Length
35 Projection
36 Depth
37 Internal surface
38 Active surface
39 Interior
40 Side face
41 Housing compartment
42 Boundary surface
43 End face
44 Insert piece
45 Bearing surface
46 Peripheral surface
47 Peripheral surface
48 Basic body
49 Side face
50 Perforated plate
51 Flexible element
52 Amount
53 Operating mechanism
54 Arrow
55 Shoe
56 Support region
57 Force introduction zone
58 Distance
59 Distance
61 Internal face
62 Boundary surface
65 Distance
66 Arrow
67 Operating zone
68 Webs
69 Thrust surface
70 Width
71 External surface
72 Thrust element

73 Arrow
74 Contact surface
75 Composite part
76 Thrust element
77 Thrust plate
78 Transmitter element
79 Thrust force
80 Hollow body
81 Housing compartment
82 Casing
83 Medium
84 Orifice
85 Connecting element
86 Groove
87 Groove surface
88 Depth
90 Surface region
91 Peripheral contour
92 Gripping surface
93 Surface
94 Hand
95 Amount
96 Contact zone
97 Bearing surface

The invention claimed is:

1. Ski comprising at least a top layer having a top surface, a running layer having a running surface lying opposite the top surface, and optionally edging elements extending in the longitudinal direction of the ski, the top surface of the top layer having at least one recess, the at least one recess being provided with a device increasing slipping and friction resistance at the top surface, the device comprising an insert piece disposed between a binding mounting region and a tip of the ski, the insert piece having a gripping surface to be held by a user for a more comfortable picking up and carrying of the ski, the gripping surface having a coefficient of static friction that is higher than a coefficient of static friction at the top surface of the top layer or having a surface roughness, which is more pronounced than the surface roughness of the top layer.

2. Ski as claimed in claim 1, wherein the device has at least one active element displaceable into an active position engaging with a surface directed towards the top surface.

3. Ski as claimed in claim 2, wherein the at least one active element of the device is a projection disposed at least partially in one of the recesses.

4. Ski as claimed in claim 1, wherein the device has an operating mechanism by means of which the device is transferable from a passive position, into an active position in order to increase slipping resistance and/or out of the active position into the passive position.

5. Ski as claimed in claim 1, wherein the at least one recess extends along an external surface through a thickness of the top layer.

6. Ski as claimed in claim 1, wherein at least one housing compartment for the insert piece is disposed between the top layer and the running layer of the ski.

7. Ski as claimed in claim 6, wherein the housing compartment is bounded by at least one internal face of the running layer or the top layer and a boundary surface, for example of a core element or a top belt.

8. Ski as claimed in claim 6, wherein the housing compartment merges into at least one of the recesses, which extends through the thickness of the top layer.

9. Ski as claimed in claim 6, wherein the insert piece is disposed at least partially in the housing compartment, which forms at least one active surface on an active element for increasing friction and slip resistance.

10. Ski as claimed in claim 6, wherein the insert piece has a plate-shaped basic body, which extends flat underneath the top layer.

11. Ski as claimed in claim 6, wherein the insert piece in the at least one housing compartment extends across at least one of the recesses opening into the housing compartment.

12. Ski as claimed in claim 6, wherein the insert piece is of an integral design and spans several recesses.

13. Ski as claimed in claim 3, wherein the at least one projection is formed by the insert piece and the distribution of projections corresponds to the distribution of recesses.

14. Ski as claimed in claim 3, wherein the recesses incorporating the projections extend across a longitudinal section in a lattice pattern.

15. Ski as claimed in claim 1, wherein the top layer forms a grid-type arrangement.

16. Ski as claimed in claim 1, comprising webs extending between the recesses, the external faces of which bound the recesses.

17. Ski as claimed in claim 1, wherein the top layer is at least slightly displaceable in the direction towards the interior, at least in the longitudinal section and in an operating zone.

18. Ski as claimed in claim 6, wherein the material of the insert piece has a modulus of elasticity which is lower than a modulus of elasticity of the material of the top layer and the material of a core-side boundary surface of the housing compartment.

19. Ski as claimed in claim 6, wherein the insert piece is made from an elastically deformable material.

20. Ski as claimed in claim 6, wherein the insert piece can be forced at least partially out of the housing compartments in the direction towards the top surface of the top layer.

21. Ski as claimed in claim 3, wherein the active surfaces of the projections can be temporarily displaced by forcing material out of the recesses or the housing compartment and forming raised areas on the top surface in the active position.

22. Ski as claimed in claim 4, wherein the operating mechanism is a displaceable or flexible top layer disposed in the region of an operating zone.

23. Ski as claimed in claim 1, wherein the top layer is cambered in the direction remote from the interior and is preferably elastically flexible in the direction towards the interior.

24. Ski as claimed in claim 6, wherein the insert piece is a surface inset, which can be placed in contact with the surface by means of the gripping surface.

25. Ski as claimed in claim 24, wherein the gripping surface of the surface inset partially replaces the top surface of the top layer and the surface inset is recessed in the top surface of the top layer.

26. Ski as claimed in claim 1, wherein the recess is a groove in the top layer, and the insert piece is affixed to the groove surfaces at a surface region by means of an adhesive bond.

* * * * *